US009730485B2

(12) United States Patent
Cuini

(10) Patent No.: US 9,730,485 B2
(45) Date of Patent: Aug. 15, 2017

(54) SHOE

(71) Applicant: ENRICO CUINI SIGNED S.R.L., Falciano (IT)

(72) Inventor: Enrico Cuini, Porto Sant'Elpidio (IT)

(73) Assignee: ENRICO CUINI SIGNED SRL, Falciano (RSM) (IT)

( * ) Notice: Subject to any disclaimer, the term of this patent is extended or adjusted under 35 U.S.C. 154(b) by 0 days.

(21) Appl. No.: 15/107,906

(22) PCT Filed: Feb. 16, 2015

(86) PCT No.: PCT/EP2015/053200
§ 371 (c)(1),
(2) Date: Jun. 23, 2016

(87) PCT Pub. No.: WO2015/124523
PCT Pub. Date: Aug. 27, 2015

(65) Prior Publication Data

US 2016/0324256 A1 Nov. 10, 2016

(30) Foreign Application Priority Data

Feb. 18, 2014 (IT) ..... MC2014A0016

(51) Int. Cl.
*A43B 7/14* (2006.01)
*A43B 13/12* (2006.01)
(Continued)

(52) U.S. Cl.
CPC ..... *A43B 7/1445* (2013.01); *A43B 7/141* (2013.01); *A43B 7/142* (2013.01); *A43B 7/143* (2013.01);
(Continued)

(58) Field of Classification Search
CPC ..... A43B 7/141; A43B 7/142; A43B 7/143; A43B 7/1445; A43B 7/148; A43B 13/026;
(Continued)

(56) References Cited

U.S. PATENT DOCUMENTS 1,039,518 A * 9/1912 Golden ..... A43B 3/0042 36/108
1,147,526 A * 7/1915 Mason et al. ..... A43B 23/22 36/76 R
(Continued)

FOREIGN PATENT DOCUMENTS

FR 2678810 1/1993

OTHER PUBLICATIONS

International Search Authority, Notification of Transmittal of the International Preliminary Report on Patentability under PCT Rule 71.1, Feb. 10, 2016.
(Continued)

*Primary Examiner* — Sharon M Prange
(74) *Attorney, Agent, or Firm* — McDermott Will & Emery LLP

(57) ABSTRACT

A shoe (A) provided with an internal side (LI) and an external side (LE) and comprising a sole (I), an intermediate sole (3) and a reinforcement insert (4) joined with the intermediate sole (3) and comprising at least one lateral wing (42,43) which is inclined and disposed on the internal side (LI) or the external side (LE) of the shoe (A).

11 Claims, 5 Drawing Sheets

(51) Int. Cl.

| | |
|---|---|
| ***A43B 13/38*** | (2006.01) |
| ***A43B 13/41*** | (2006.01) |
| ***A43B 17/00*** | (2006.01) |
| ***A43B 13/02*** | (2006.01) |
| ***A43B 13/14*** | (2006.01) |

(52) U.S. Cl.
CPC ..... *A43B 7/148* (2013.01); *A43B 13/026* (2013.01); *A43B 13/125* (2013.01); *A43B 13/141* (2013.01); *A43B 13/38* (2013.01); *A43B 13/386* (2013.01); *A43B 13/41* (2013.01); *A43B 17/006* (2013.01)

(58) Field of Classification Search
CPC ..... A43B 13/125; A43B 13/141; A43B 13/38; A43B 13/41
USPC ..... 36/43, 76 R, 76 C, 107, 108
See application file for complete search history.

(56) References Cited

U.S. PATENT DOCUMENTS

| | | | | | |
|---|---|---|---|---|---|
| 1,851,365 | A | | 3/1932 | McGee | |
| 1,907,995 | A | * | 5/1933 | Nickerson | A43B 7/142 36/163 |
| 1,985,919 | A | * | 1/1935 | Delbon | A43B 7/142 36/168 |
| 2,040,143 | A | | 5/1936 | Kubeck | |
| 2,086,999 | A | * | 7/1937 | Hack | A43B 7/1415 36/180 |
| 2,142,839 | A | | 1/1939 | Flint | |
| 2,306,609 | A | * | 12/1942 | Jerro | A43B 23/22 36/105 |
| 3,906,570 | A | * | 9/1975 | Revill | A43B 7/141 12/146 B |
| 5,720,117 | A | * | 2/1998 | Toschi | A43B 23/22 36/169 |
| 5,832,634 | A | * | 11/1998 | Wong | A43B 13/026 36/107 |
| 7,464,490 | B2 | * | 12/2008 | Lebo | A43B 13/026 36/102 |
| 7,614,164 | B2 | * | 11/2009 | Morales | A43B 7/1445 36/24.5 |
| 2007/0227042 | A1 | | 10/2007 | Chan | |

OTHER PUBLICATIONS

International Search Authority, Written Opinion of the International Search Authority under PCT rule 43bis.1, Apr. 23, 2015.

* cited by examiner

SHOE

CROSS-REFERENCE TO RELATED APPLICATIONS

The present patent application claims priority under 35 U.S.C. §365 to, and is the U.S. National Phase under 35 U.S.C. §371 of, International Patent Application No. PCT/EP2015/053200 entitled "IMPROVED SHOE," to Enrico Cuini, filed on Feb. 16, 2015, and designating the United States, which claims priority to Italian Patent Application No. MC2014A000016, entitled "CALZATURA PERFEZIONATA," to Enrico Cuini, filed on Feb. 18, 2014. The contents of the above two patent applications are hereby incorporated by reference in their entirety, for all purposes.

BACKGROUND

As it is known, the shoes that are currently found on the market rarely follow the features of the user's feet, being designed for a standard foot that is inevitably different from the foot of the final user who will wear the shoes.

For this reason it is often necessary to use arch supports comprising a lower side adapted to adhere to the shoe in the best way possible, and an upper side on which the user's foot rests.

BRIEF SUMMARY

The present patent application relates to an improved shoe.

The shoe has been devised to satisfy a need that has been felt for long in the footwear sector. With the passing of time, in addition to being modified aesthetically, shoes have been improved from the technical-functional viewpoint in order to offer the maximum comfort.

Special attention is to be paid to the comfort issue because the balance and the correct position of the body depend on the feet and on the way in which they rest on the ground.

DETAILED DESCRIPTION

Figure 1:
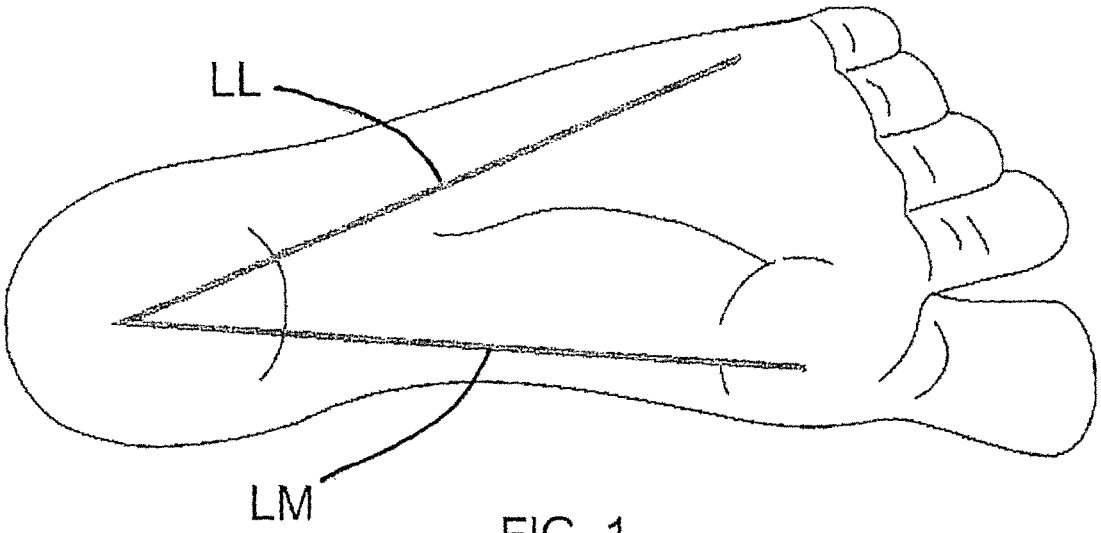
FIG. 1 shows a foot sole with projections of the medial longitudinal arch (LM) and the lateral longitudinal arch (LL).

The purpose of arch supports is to customize the internal configuration of a standard shoe. However, a well-structured and well-built shoe is necessary for an arch support to work properly.

When buying shoes, users tend to follow fashion trends, rarely caring for the structural configuration of the shoes that determines the arch support of the user's foot.

In spite of being well-structured and resistant, inner soles cannot act as arch supports. As a matter of fact, arch supports have an enveloping structure that sustains the entire arch support of the foot in such manner to guarantee the correct foot support and the maximum surface exposed to the weight load.

In any case, arch supports must be designed by professionals, also through a dynamic analysis used to detect the movement of the foot during walking and a study of the load distribution.

The fact that more and more often the incorrect position of individuals is corrected by means of arch supports demonstrates the importance of the aforementioned issue. In addition to being aesthetically pleasant, standard shoes must sustain the arch support correctly in order to prevent the user's foot from assuming a harmful position.

Although the type of shoe is not a decisive factor for the advantages offered by the innovative structure of the shoe, the present disclosure has been devised from the critical observation of the structure of women's high-heel shoes in view of their intrinsic configuration that negatively affects the position of the user's foot.

In such a type of shoes, it is extremely important to distribute the user's weight correctly and uniformly, without completely discharging it on the toe or heel.

Women's high or mid-heel shoes are an example of "assembled" shoes, which comprise:

- a sole;
- an intermediate sole disposed onto the sole;
- an upper comprising lower perimeter edges that are folded and fixed under the intermediate sole.

Otherwise said, the lower perimeter edges of the upper of "assembled" shoes are tightened and fixed between the intermediate sole and the sole.

Such a production technology provides for using a last, which consists in a foot model made of wood or plastics. First, the intermediate sole is fitted on the last, in correspondence of the sole, and then the upper is fitted, ironing, folding and fixing the lower perimeter edges of the upper under the edge of the intermediate sole by means of metal nails or staples.

Considering that its main function is to make the shoe rigid, the intermediate sole comprises longitudinal steel reinforcements that stiffen the entire shoe and provide a sufficient rigidity of the surface of the intermediate sole in contact with the foot.

In this type of shoes, the upper is generally made of a very thin material, in such manner that it can embrace the wearer's foot with an enveloping shape.

In particular, the fabric or leather upper extends upwards from the intermediate sole, embracing the foot both on the internal and on the external side, including the lateral and medial arch support.

With reference to the foot it is noted that:

- going from the heel to the toe, the medial longitudinal arch is composed of the calcaneum—the calcaneal tuberosity resting on the ground and forming the rear vertex of the foot sole—the astragalus, which rests on the calcaneum, the navicular bone, which is the keystone of the arch, the first cuneiform bone and the fifth metatarsal bone, the head of which rests on the ground and forms the medial vertex of the foot sole (the physiological height of the longitudinal arch being normally comprised between 15 mm and 18 mm);

in a posteroanterior view the lateral longitudinal arch is composed of the calcaneum, the astragalus, the cuboid bone and the fifth metatarsal (the highest point of the arch being approximately 3 mm-5 mm).

FIG. 1 shows a foot sole with projections of the two aforementioned arches, i.e. the medial longitudinal arch (LM) and the lateral longitudinal arch (LL).

In correspondence of the two arches (LM and LL), a high or mid-heel shoe is exclusively provided with a fabric or leather upper, which is flexible enough in order not to impair comfort and adjust to the geometrical features of the wearer's foot, but does not provide the necessary support to the foot.

Otherwise said, the entire weight of the body discharged on the foot is distributed on the upper side of the intermediate sole, which is substantially flat and is the only support surface of the foot.

In view of the above, intermediate soles are often provided with the aforementioned metal reinforcements in order to increase rigidity and guarantee the perfect fixing of the heel to the intermediate sole.

Evidently, the intermediate sole has a higher or lower rigidity according to the type of shoe wherein it is assembled.

As a matter of fact, each type of shoe determines a different distribution of the body weight on the sole of the user's foot: for example, due to the difference in height between the heel and the forefoot, high-heel shoes cause a forward inclination of the body and an overload on the toe, whereas shoes without heels determine an overload on the heel.

Consequently, it is necessary to customize each and every intermediate sole in terms of materials and rigidity according to the specific type of shoe where it is used in order to guarantee a correct arch support.

In view of the above, each type of shoes requires the making of a specific intermediate sole, the rigidity of which cannot be modified during assembly according to the specific requirements of the user, thus impairing comfort.

Shoes with inserts, which are applied, sewn, or printed in order to pad the shoe internally and reinforce the upper, have been devised in order to provide a better arch support.

U.S. Pat. No. 2,142,839 discloses a shoe, specifically a heavy-duty boot, in which the upper is stiffened in the shank portion by means of sewn fabrics that reduce the deformation suffered by the upper when using the shoe.

U.S. Pat. No. 2,040,143 discloses a support adapted to be inserted in a shoe and fixed with glue; the function of the support is to pad the interior of the shoe, providing a soft fit. Such an insert is commonly known as "footbed". In most cases, it is removable and not permanently fixed inside the structure of the shoe. Moreover, the "footbed" is disposed onto the intermediate sole.

FR2678810 discloses a shoe comprising a heel shock-absorber element that cooperates with only one rigid wing to sustain the medial arch support.

Said shoe comprises:

a sole comprising a first side adapted to face the ground, and a second side adapted to face the opposite side;

an intermediate sole disposed onto the sole; said intermediate sole comprising only one wing to sustain the medial arch support;

an upper joined to the intermediate sole;

a shock-absorber element disposed onto the intermediate sole in correspondence of the heel.

It is noted that the intermediate sole is composed of a flexible portion, in correspondence of the forefoot, and a rigid portion, which extends from the forefoot to the heel; a support element is obtained in one piece with said rigid portion of the intermediate sole. Such a support element is joined to the intermediate sole. Therefore, in spite of sustaining the arch support, it does not dynamically follow the movements of the foot during walking.

Such an arrangement does not reduce the volume of the shoe and the external position of the wing does not provide a correct arch support, especially during walking.

US2007/227042 discloses a shoe comprising an outsole provided with an upper recess portion to house a thermoplastic rubber for absorbing the vibrations of the wearer's foot and reducing the burden on the foot.

The main purpose of the present disclosure is to remedy the drawbacks of the prior art by devising an improved shoe that is versatile, comfortable and able to guarantee a correct arch support for the user's foot, as well as easily customizable in order to improve aesthetics and comfort.

Another purpose of the present disclosure is to devise a new type of shoes, the structure of which is characterized, without having to apply inserts and/or padding, by maximum ergonomics, low volume and a tapered intermediate sole so that the shoe has a higher elasticity in transverse direction with the same longitudinal rigidity.

It is noted that shoes with inserts, which are either applied or produced in one piece with the intermediate sole, have been devised in the past in order to provide arch support. The purpose of the inserts is to cooperate with an intermediate sole, the dimensions of which remain basically unchanged. Reference is made to the rigid portion of the intermediate sole, wherein width decreases slightly from the heel to the toe, and significantly increases in the front portion joined with the flexible portion of the intermediate sole.

With reference to the dimensions of a standard intermediate sole, such as the one used for a size 37 woman's shoe with heels, the minimum width of the intermediate sole is normally not lower than 3.7 cm. Considering that a size 37 woman's shoe is designed to receive a foot with 25 cm±0.5 cm length, said size 37 intermediate sole must not have a total length lower than 25 cm. In view of the above, the ratio between the length and the width of the intermediate sole has a maximum value of 6.75.

The purpose of the present disclosure is to devise a shoe comprising a size 37 intermediate sole with a minimum width lower than 3 cm, preferably comprised between 1.8 cm and 2.5 cm, and accordingly with a length and width ratio higher than 8.3, preferably comprised between 1 0 and 15.

The shoe is provided with an internal side and an external side and comprises:

a sole comprising a first side facing the ground, and a second side facing the opposite side;

an intermediate sole disposed onto the sole; said intermediate sole comprising a flexible portion in the forefoot and a rigid portion extending from the forefoot to the heel; said intermediate sole having a length and a minimum width in the rigid portion;

an upper joined to the intermediate sole.

The ratio between the length and the minimum width of the intermediate sole is higher than 8.3.

The shoe comprises an innovative reinforcement insert, which is joined to the intermediate sole and comprises:

a central longitudinal portion extending between the heel and the toe of the user's foot, which is interfaced with the sole of the user's foot;

at least one lateral wing with upward inclination disposed on the internal side or on the external side of the shoe, in one of the two arches (LM and LL) in such manner to embrace the sides of the user's foot;

a concave front edge with concavity facing the toe of the user's foot.

Figure 2:
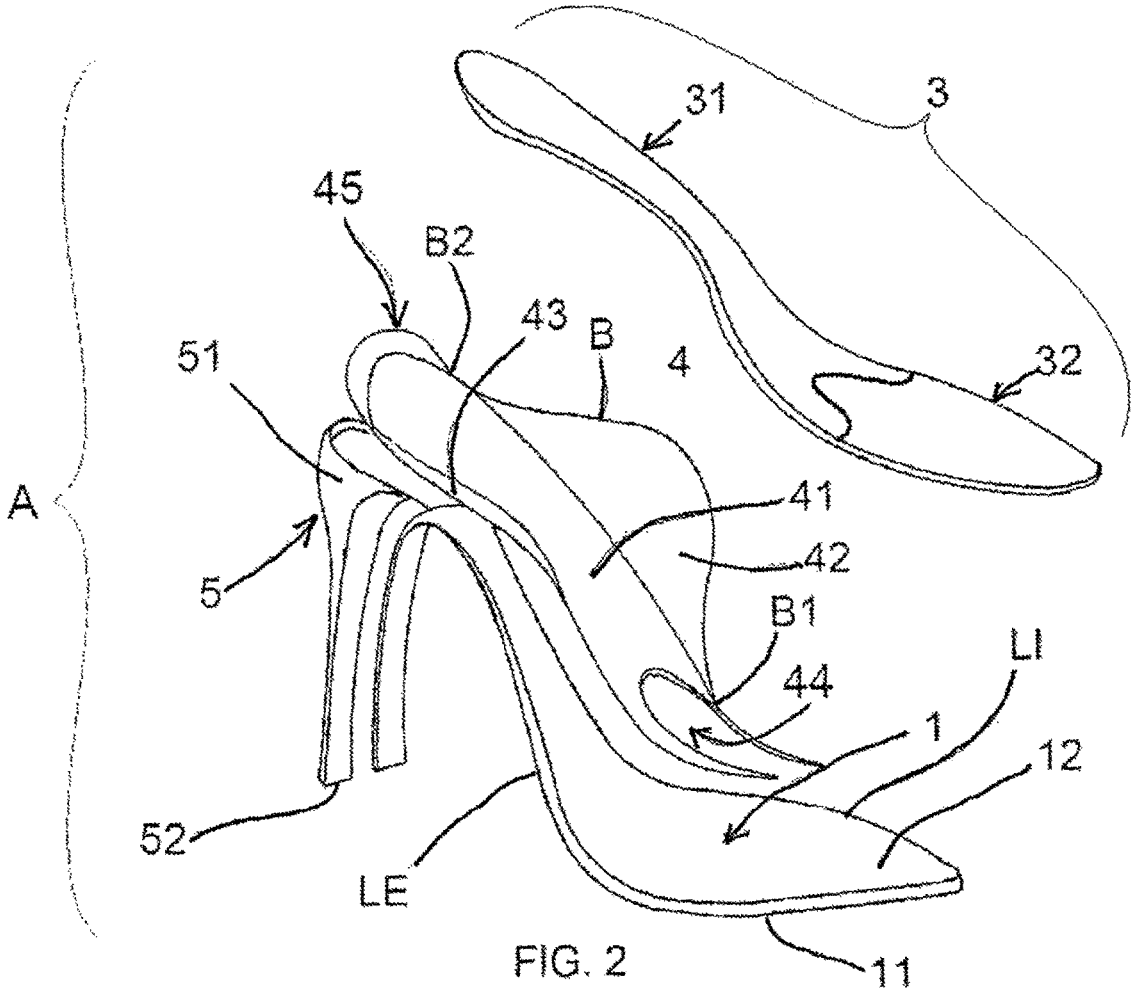
FIG. 2 is an axonometric exploded view of the shoe.
Figure 3:
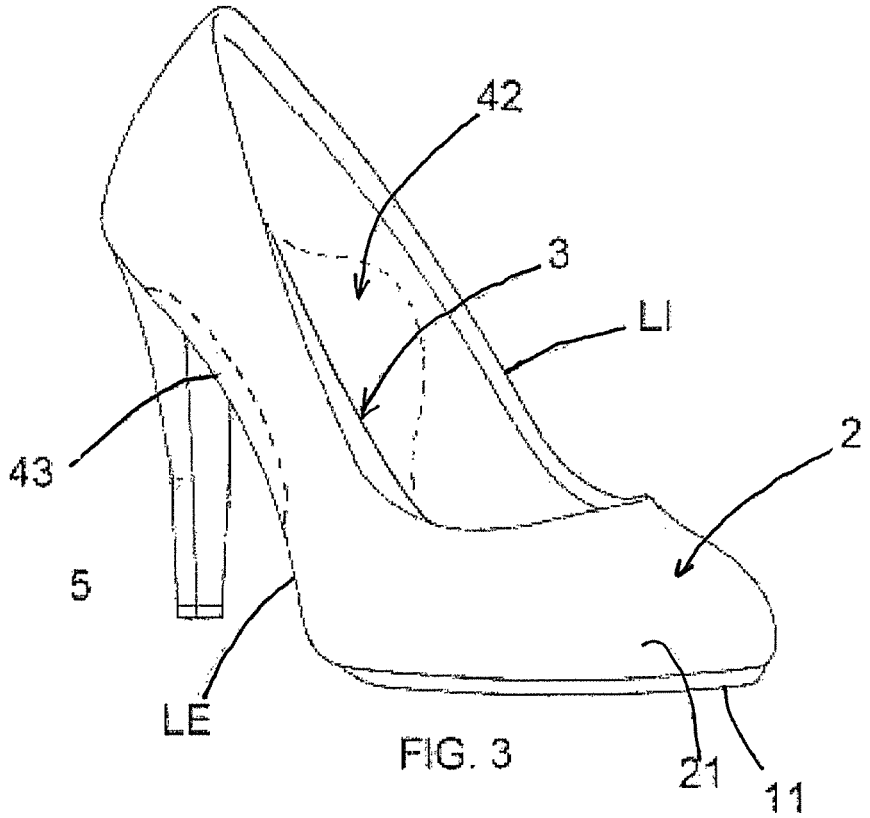
FIG. 3 is an axonometric view of the shoe, in assembled condition, in which the lateral wings of the reinforcement insert are externally embraced by the upper.
Figure 4:
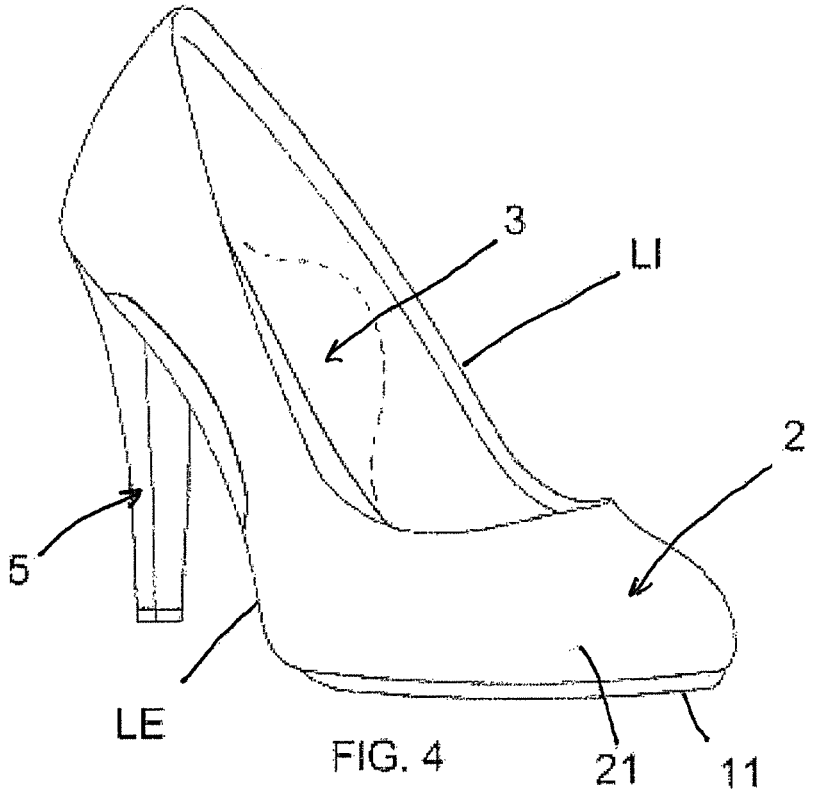
FIG. 4 is the same as FIG. 3, except in that the lateral wings of the reinforcement insert are disposed on the external side of the upper.
Figure 5:
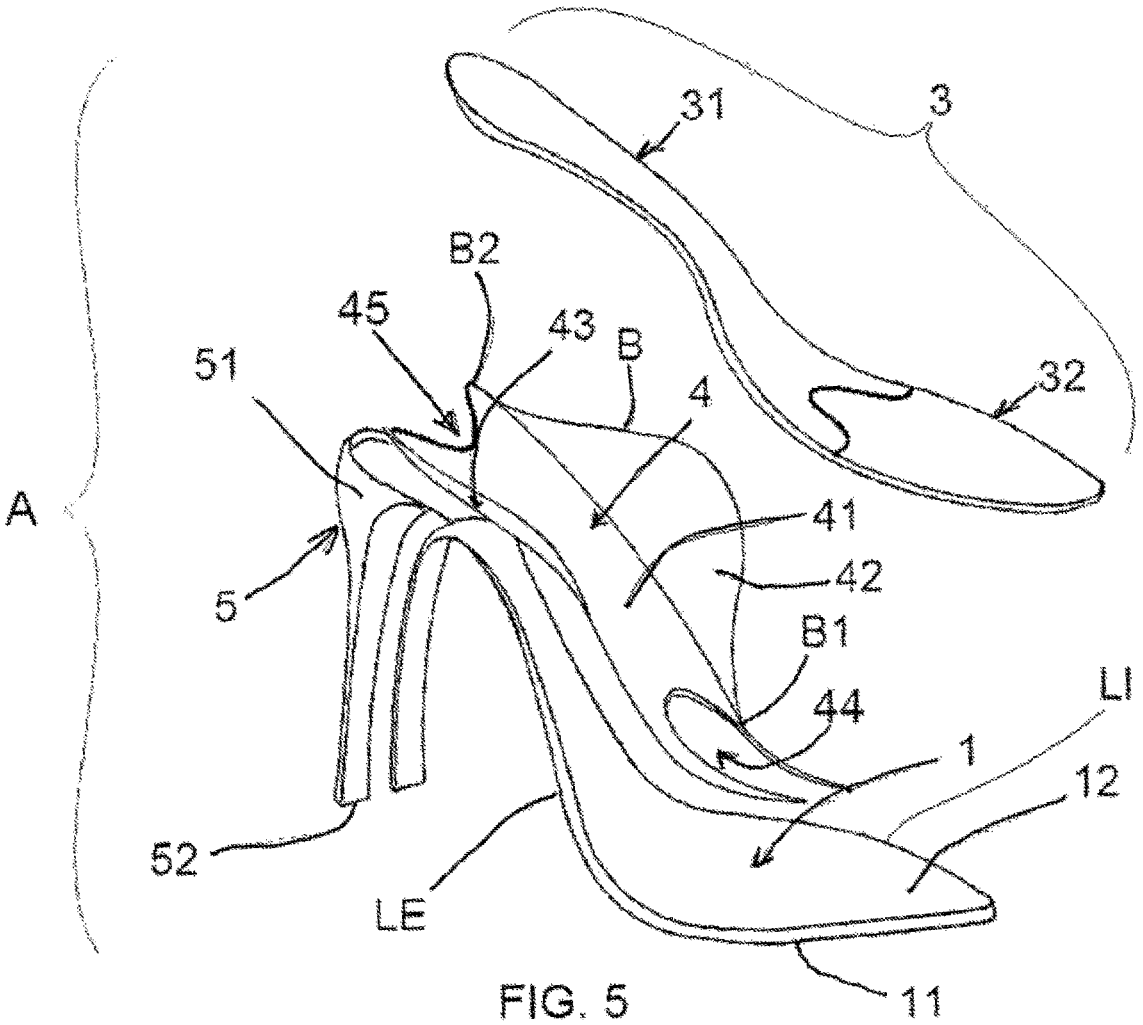
FIG. 5 is the same as FIG. 2, except for the reinforcement insert that is provided on the back with an edge with concavity facing the heel.
Figure 6:
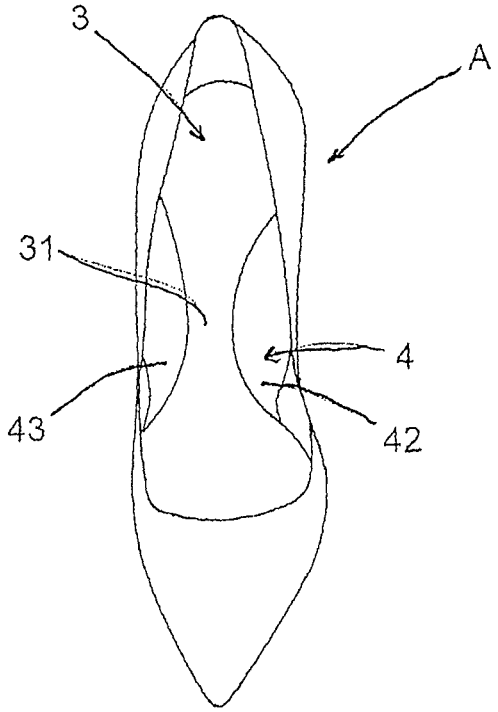
FIG. 6 is a front diagrammatic view of the shoe of FIG. 4.

For explanatory reasons the description of the improved shoe according to the present disclosure continues with reference to the attached drawings, which only have illustrative, not limiting value, wherein:

FIG. 2 is an axonometric exploded view of the shoe;

FIG. 3 is an axonometric view of the shoe, in assembled condition, in which the lateral wings of the reinforcement insert are externally embraced by the upper;

FIG. 4 is the same as FIG. 3, except in that the lateral wings of the reinforcement insert are disposed on the external side of the upper;

FIG. 5 is the same as FIG. 2, except for the reinforcement insert that is provided on the back with an edge with concavity facing the heel;

FIG. 6 is a front diagrammatic view of the shoe of FIG. 4.

Figure 7:
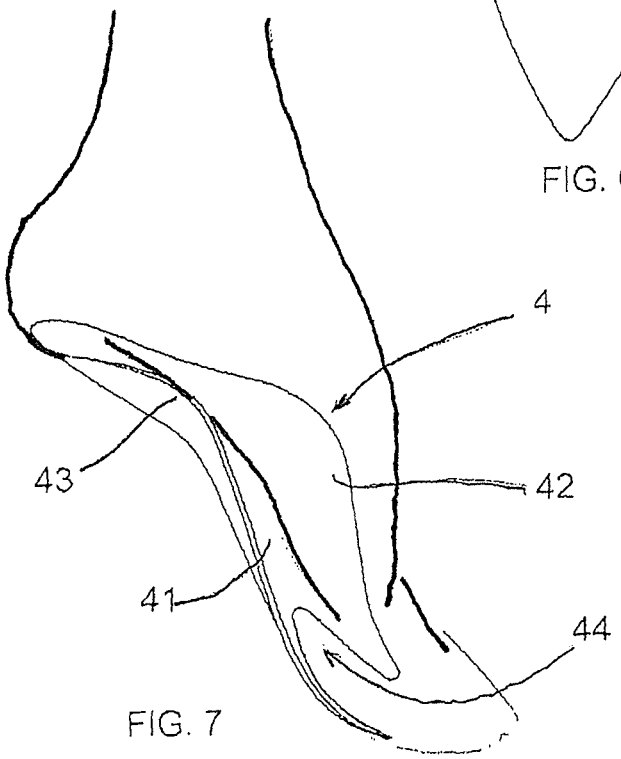
FIG. 7 is a side view of the reinforcement insert.

FIG. 7 is a side view of the reinforcement insert.

With reference to FIGS. 2 and 3, the shoe (A) is provided with an internal side (LI) and an external side (LE) and comprises:

a sole (1) comprising a first side (11) facing the ground, and a second side (12) facing the opposite side;

an intermediate sole (3) disposed onto the sole (1); said intermediate sole (3) comprising a flexible portion (32) in the forefoot and a rigid portion (31) extending from the forefoot to the heel;

an upper (2) comprising lower perimeter edges that are folded and fixed under the intermediate sole (3) and provided with an external side (21) adapted to remain visible;

a heel (5) comprising an upper end (51) joined to the intermediate sole (3) and a lower end (52) adapted to come in contact with the ground.

The shoe (A) comprises a reinforcement insert (4) shaped as a plate, which advantageously extends from the heel to the metatarsus of the user's foot and is joined with the intermediate sole (3), as shown in FIGS. 2 and 5.

Said reinforcement insert (4) can be made of any suitable material, preferably carbon or leather, reinforced cardboard, plastics, or of a thin metal plate.

More precisely, said reinforcement insert (4) is disposed between the sole (1) and the intermediate sole (3) and said intermediate sole (3) is advantageously provided, in correspondence of said rigid portion (31), with a longitudinal metal reinforcement (not shown in the enclosed figures, being of known type), which gives adequate rigidity to the intermediate sole (3).

Alternatively, said reinforcement insert (4) can be integrated in the intermediate sole (3) by means of welding or gluing, when said reinforcement insert (4) is made of metal and said intermediate sole (3) is provided with the longitudinal metal inserts.

Otherwise said, the reinforcement insert (4) can rest on the intermediate sole (3) or can be inserted in the intermediate sole (3) in such manner to integrate or replace the longitudinal metal insert of the intermediate sole (3).

It is noted that the use of the reinforcement insert (4) joined to an intermediate sole (3) allows for making the shoe stronger and reducing the width of the rigid portion (31) of the intermediate sole (3) considerably, as shown in FIG. 6.

Moreover, the reinforcement insert (4) allows for reducing the thickness and the weight of the intermediate sole (3), which can be deprived of the metal longitudinal inserts that prevent from carrying out traditional X-ray quality checks to make sure that the nails used to assemble the upper have been removed.

Such an X-ray quality check is made on the upper (2) fixed to the intermediate sole (3) before assembling the reinforcement insert (4).

With reference to FIG. 2, said reinforcement insert (4) comprises:

a central longitudinal portion (41) extending between the heel and the toe of the user's foot, which is interfaced with the sole of the user's foot;

two lateral wings (42, 43) that are inclined upwards and respectively disposed on the internal side and on the external side of the shoe (A).

Each lateral wing (42, 43) of the reinforcement insert (4) is made of flexible material, in such manner to adjust to the configuration of the sides of the user's foot, and comprises an upper curvilinear edge (B) provided with downward-facing concavity. Moreover, the upper curvilinear edge (B) of each lateral wing (42, 43) is provided with two ends (B1, B2) wherein the upper curvilinear edge (B) is joined with said central longitudinal portion (41) of the reinforcement insert (4).

Each lateral wing (42, 43) is shaped in such manner to be disposed in one of the two arches (LM and LL) of the user's foot.

Specifically, the shoe (A) comprises an internal lateral wing (42) disposed on the internal side (LI) of the shoe (A), and an external lateral wing (43) disposed on the external side (LE) of the shoe (A), as shown in FIG. 2.

The internal lateral wing (42) of the reinforcement insert (4) is provided with a profile that is interfaced and conjugated with the medial longitudinal arch (LM) of the foot sole, whereas said external lateral wing (43) is provided with a profile that is interfaced and conjugated with the lateral longitudinal arch (LL) of the foot sole.

With reference to FIG. 2, said reinforcement insert (4) is provided with a front concave edge (44) with concavity facing the toe of the user's foot. In proximity to the metatarsal joint, the concavity reduces the longitudinal rigidity of the reinforcement insert (4), which needs to bend longitudinally when the user is walking.

With reference to FIG. 7, it can be noted that, when seen laterally, the front concave edge (44) is provided with an upward-facing longitudinal concavity, especially in the external side of the shoe; the presence of said longitudinal concavity improves the bending of the reinforcement insert (4) and of the lateral wings (42, 43).

According to a preferred embodiment of the present disclosure shown in FIG. 5, the reinforcement insert (4) has a back concave edge (45), with concavity facing the heel (5), in such manner that the shoe (A) has a higher longitudinal flexibility on the heel (5) when the user is walking.

Because of the configuration and the material chosen for the reinforcement insert (4)—which is preferably made of carbon or fiber composite materials (agglomerates with nanotechnological resins with different flexibility)—the two lateral wings (42, 43) of the reinforcement insert (4) give a rigid arch support to the person wearing the shoe (A) and standing in erected position for a long period of time.

The front concave edge (44) and, partially, the concavity of the back edge (45) of the reinforcement insert (4) give a longitudinal flexibility to the reinforcement insert (4) that, being pushed by the user's foot during walking, can bend more in said two edges (44, 45), consequently separating the lateral wings (42, 43); because of the separation of the two lateral wings (42, 43), it can be said that the lateral wings (42, 43) dynamically follow the foot arches when the foot is rolling, and provide a rigid support as soon as the user's weight is statically discharged on the shoe (A).

According to the type of shoe, the reinforcement insert (4) can have a different rigidity in different areas, either using different materials or the same material with a different thickness or by suitably dimensioning the two lateral wings (42, 43).

In particular, the reinforcement insert (4) has a side adapted to be interfaced with the user's foot, which is advantageously coated with a soft resilient material in order to improve the comfort of the shoe.

Advantageously, the reinforcement insert (4) of the shoe (A) is made of carbon, polycarbonate or plastic materials and is milled on wooden supports.

Because of the provision of said reinforcement insert (4), the same intermediate sole (3) can be used for all types of shoes (high-heel shoes, pumps, comfort shoes, men's shoes, etc.), and the rigidity of the shoe can be adjusted by modulating the rigidity of the reinforcement insert (4) applied under the intermediate sole (3).

In order to personalize the shoe and make the innovative structural configuration of the shoe (A) immediately visible, the reinforcement insert (4) is disposed on the external side (21) of the upper (2) by means of gluing or seaming, thus remaining visible when the shoe (A) is worn, accentuating the inclination and height of the heel (5) and improving the aesthetics of the shoe (A).

Otherwise said, the reinforcement insert (4) can be joined to the intermediate sole (3) before fitting the upper (2) on the last, in such manner that the reinforcement insert (4) is externally embraced by the upper (2), the lower perimeter edges of which are folded and fixed under the intermediate sole (3), as shown in FIG. 3.

Alternatively the reinforcement insert (4) can be joined with the intermediate sole (3) after fitting the upper (2) on the last. In view of the above, the lateral wings (42, 43) of the reinforcement insert (4) remain visible on the sides of the shoe (A), as shown in FIG. 4.

The present disclosure also relates to an intermediate sole (3) comprising a reinforcement insert (4) like the one described above and illustrated in the enclosed figures.

The invention claimed is:

1. A shoe with an internal side and an external side comprising:

a sole comprising a first side configured to face the ground, and a second side facing the opposite side;

an intermediate sole disposed onto the sole; said intermediate sole having a length and a minimum width in a central portion of the intermediate sole, the intermediate sole having a rigid portion configured to extend from a forefoot to a heel and to sustain an arch support without following a movement of a user's foot during walking;

an upper joined to the intermediate sole; and a reinforcement insert joined with the intermediate sole, said reinforcement insert comprising:

a central longitudinal portion configured to extend between the heel and a toe of a user's foot, which is configured to interface with a plantar surface of the user's foot, an internal lateral wing tilted upwards and disposed on the internal side of the shoe, said internal lateral wing being provided with a profile that is configured to interface and to conjugate with a medial longitudinal arch of a foot sole, characterized in that a ratio between the length and the minimum width of the intermediate sole is higher than 8.3, and the minimum width of the intermediate sole is lower than 3 cm for a shoe configured to fit the user's foot when the user's foot has a length between 24.5 cm and 25.5 cm, and an external lateral wing provided with a profile that is configured to interface and to conjugate with a lateral longitudinal arch of the foot sole, wherein said internal lateral wing and external lateral wing of the reinforcement insert are configured to give a rigid arch support to the user's foot.

2. The shoe of claim 1, wherein said reinforcement insert comprises a concave front edge with concavity configured to face the toe of the user's foot, so that when the reinforcement insert being pushed by the user's foot during walking, the reinforcement insert can bend more in said concave front edge, consequently separating the internal lateral wing from the external lateral wing, which are configured to dynamically follow the medial longitudinal arch and the lateral longitudinal arch of the foot sole, when the foot is rolling, and provide a rigid support as soon as the user's weight is statically discharged on the shoe.

3. The shoe of claim 2, wherein said intermediate sole comprises a flexible portion in the forefoot configured to extend from the forefoot to the toe of the user's foot, and joined to the rigid portion.

4. The shoe of claim 1, wherein said reinforcement insert is made of carbon or fiber composite materials.

5. The shoe of claim 1, wherein said ratio between the length and the minimum width of the intermediate sole is comprised between 10 and 15.

6. The shoe of claim 1, wherein:

at least one of the external lateral wing or the internal lateral wing of said reinforcement insert has an upper curvilinear edge with downward-facing concavity; and said upper curvilinear edge of said at least one of the external lateral wing or the internal lateral wing being provided with a first end and a second end and being joined at the first and second ends with the central longitudinal portion.

7. The shoe of claim 1, wherein said reinforcement insert has a differentiated rigidity.

8. The shoe of claim 1, comprising a heel with an upper end joined to the intermediate sole and a lower end adapted to come in contact with the ground, wherein said reinforcement insert is configured to extend from the heel to a metatarsus of the user's foot.

9. The shoe of claim 1, wherein said reinforcement insert comprises a concave back edge with concavity configured to face the heel.

10. The shoe of claim 1, wherein said reinforcement insert is integrated in the intermediate sole by means of welding or gluing.

11. The shoe of claim 1, wherein said reinforcement insert is interposed between the intermediate sole and the sole.

* * * * *